US005133820A

United States Patent [19]

Katayama et al.

[11] Patent Number: 5,133,820

[45] Date of Patent: Jul. 28, 1992

[54] THERMAL TRANSFER MATERIAL

[75] Inventors: Masato Katayama; Kazumi Tanaka, both of Yokohama; Hiroshi Sato, Hiratsuka; Nobuyuki Kuwabara, Tokyo, all of Japan

[73] Assignee: Canon Kabushiki Kaisha, Tokyo, Japan

[21] Appl. No.: 449,143

[22] Filed: Dec. 13, 1989

Related U.S. Application Data

[63] Continuation of Ser. No. 887,913, Jul. 22, 1986, abandoned.

[30] Foreign Application Priority Data

| | | | |
|---|---|---|---|
| Jul. 29, 1985 | [JP] | Japan | 60-165949 |
| Jul. 29, 1985 | [JP] | Japan | 60-165950 |
| Jul. 29, 1985 | [JP] | Japan | 60-165951 |
| Sep. 2, 1985 | [JP] | Japan | 60-491846 |
| Dec. 26, 1985 | [JP] | Japan | 60-291887 |

[51] Int. Cl.[5] ..... B41M 5/26

[52] U.S. Cl. ..... 156/234; 156/277; 427/146; 427/197; 427/256; 427/288; 428/195; 428/206; 428/327; 428/488.1; 428/913; 428/914

[58] Field of Search ..... 156/230, 234, 239, 240, 156/277; 427/146, 197, 256, 288; 428/195, 206, 211, 323, 327, 484, 488.1, 488.4, 913, 914

[56] References Cited

U.S. PATENT DOCUMENTS

| | | | |
|---|---|---|---|
| 4,564,534 | 1/1986 | Kushida | 427/256 |
| 4,739,338 | 4/1988 | Tanaka | 346/1.1 |

FOREIGN PATENT DOCUMENTS

| | | | |
|---|---|---|---|
| 995008 | 8/1976 | Canada | 428/195 |
| 0163297 | 12/1985 | European Pat. Off. | 428/913 |
| 2365097 | 7/1974 | Fed. Rep. of Germany | 428/195 |
| 105395 | 9/1982 | Japan | 428/195 |
| 0185191 | 11/1982 | Japan | 428/488.4 |
| 0045993 | 3/1983 | Japan . | |
| 120493 | 7/1984 | Japan | 428/195 |
| 0201894 | 11/1984 | Japan | 428/914 |
| 82393 | 8/1985 | Japan | 428/195 |
| 0860590 | 2/1961 | United Kingdom | 428/913 |
| 1013101 | 12/1965 | United Kingdom | 428/913 |
| 1265527 | 3/1972 | United Kingdom | 428/913 |
| 1362475 | 8/1974 | United Kingdom | 428/913 |
| 1419804 | 12/1975 | United Kingdom | 428/913 |
| 1451671 | 10/1976 | United Kingdom | 428/913 |
| 1504338 | 3/1978 | United Kingdom | 428/913 |
| 2161950 | 1/1986 | United Kingdom | 428/913 |

*Primary Examiner*—B. Hamilton Hess

*Attorney, Agent, or Firm*—Fitzpatrick, Cella, Harper & Scinto

[57] ABSTRACT

A thermal transfer material, comprising a support, and a heat-transferable ink layer. The heat-transferable ink layer includes at least two species of domains of heat-fusible materials. The thermal transfer material provides a transfer image of high density and clear edges even on a recording medium having poor surface smoothness, particularly when peeled off the recording medium within 50 milli-seconds after the heat application.

18 Claims, 4 Drawing Sheets

THERMAL TRANSFER MATERIAL

This application is a continuation-in-part of application Ser. No. 887,913 filed Jul. 22, 1986, now abandoned.

BACKGROUND OF THE INVENTION

The present invention relates to a thermal or heat-sensitive transfer material which can provide transferred recorded images of good image quality even on a recording medium with poor surface smoothness, and a thermal transfer recording method using the same.

The thermal or heat-sensitive transfer recording method has advantageous features in that it can provide recorded images on plain paper in addition to the general features of the thermal recording method, i.e., that the apparatus therefor is light in weight, compact, free of generating noise and also excellent in operability and maintenance. For these reasons, the thermal transfer recording method has been recently widely used.

The thermal transfer recording method employs a thermal transfer material, comprising generally a heat transferable ink containing a colorant dispersed in a heat-fusible binder applied on a support generally in the form of a sheet. The thermal transfer material is superposed on the recording medium so that the heat-transferable ink layer may contact the recording medium, and the ink layer, melted or softened (hereinafter simply referred to as "melted") by supplying heat by a thermal head from the support side of the thermal transfer material while supporting the back side of the recording medium, is transferred onto the recording medium, thereby forming a transferred ink image corresponding to the pattern of the heat supplied on the recording medium.

However, as the transfer is effected based on the viscosity of the ink melted on heating in the thermal transfer recording method, the transfer recording performance, namely the recorded image quality is greatly influenced by the surface smoothness of the recording medium, and therefore, although good transfer can be effected on a recording medium with high smoothness, the image quality will be markedly lowered on a recording medium with poor smoothness. For this reason, a paper having a high surface smoothness is required in order to effect good quality of image recording. However, plain paper which is the most typical recording medium possesses various degrees of concavities and convexities due to entanglement of fibers. Accordingly, in the case of a paper with a large surface unevenness, the heat-melted ink cannot penetrate into the fibers of the paper during transfer recording, but only adheres at the convexities of the surface or in the vicinity thereof, with the result that the transferred image at the edge portion is not sharp or a part of the image may be lacking to lower the image quality. For improvement of the image quality, there has been taken a measure of using a heat-fusible ink having a low melt viscosity, or increasing the thickness of the heat-transferable ink layer based on a concept of causing the melted ink to penetrate faithfully into the surface unevenness of paper, etc. However, the above measures have not been successful in improving the image quality. Further, when an ink having a low melt viscosity is used, the heat transferable ink layer will be sticky at a relatively low temperature to result in lowering in storability or troubles such as staining at non-image portions of the recording medium or blurring of transferred images. Further, in a case where a transferable ink layer having a large thickness is used, blurring becomes remarkable and a large amount of heat supply from a thermal head is required to raise the recording speed.

SUMMARY OF THE INVENTION

An object of the present invention is to provide a heat-sensitive transfer material capable of giving printed letters or transferred images of high density and clear edges not only on a recording medium having good surface smoothness but also on a recording medium having poor surface smoothness, while retaining various thermal transfer characteristics.

Another object of the present invention is to provide a thermal transfer recording method capable of providing recorded images of good quality even on a recording medium having poor surface smoothness.

A further object of the present invention is to provide a process for advantageously producing a thermal transfer material with excellent characteristics as described above.

According to the present invention, there is provided a thermal transfer material comprising: a support, and a heat-transferable ink layer containing a heat-fusible material disposed on the support; the heat-transferable ink layer comprising at least two species of domains of heat-fusible materials.

According to another aspect of the present invention, there is provided a thermal transfer recording method characterized by comprising: providing a thermal transfer material comprising a support and an ink layer of at least two species of domains disposed on the support; superposing the thermal transfer material on a recording medium so that the ink layer contacts the recording medium; supplying a heat pulse to the thermal transfer material from the support side; and peeling the thermal transfer material off the recording medium within 50 milli-seconds after the heat application to cause a selective transfer of the ink layer to the recording medium.

The present invention further provides a process for producing a thermal transfer material characterized by forming the above mentioned thermal transfer ink layer by applying a coating liquid containing a mixture of at least two species of heat-fusible resin particles and drying the applied coating liquid.

These and other objects, features and advantages of the present invention will become more apparent upon a consideration of the following description of the preferred embodiments of the present invention taken in conjunction with the accompanying drawings, wherein like parts are denoted by like reference numerals.

DETAILED DESCRIPTION OF THE INVENTION

In the thermal transfer material according to the present invention, the heat-transferable ink layer comprises domains of two or more species of a heat-fusible material, so that the cohesion in the ink layer can be reduced compared to that in a homogeneous system. The domains of at least two such species, when heated in a pattern, cause fusion and uniformization to produce a viscous force acting as an adhesion (adhesive force) of a heated ink pattern onto a recording medium and form a recorded image of a high cohesion. Furthermore, there are domains of at least two species having different functions or physical properties such as adhesion and cohesion on heating, so that respective functions or physical properties can be readily developed compared with a case of a homogeneous system. In this way, in the heat-transferable ink layer, there occurs a large difference in cohesion between a heated portion (pattern-heated portion) and a non-heated portion, so that cutting of a heated ink pattern is remarkably promoted to provide a clear transfer recorded image.

Further, because of improvement in cohesion and adhesion of the ink layer in the pattern-heated portion, sharp edge cutting is remarkably promoted to leave recorded images free of lacking even on a surface unevenness on the recording medium. As a result, the thermal transfer material according to the present invention provides a transfer recorded image of a good printing quality even on a recording medium having a poor surface smoothness.

The present invention will be explained in further detail hereinbelow. In the following description, "%" and "parts" representing quantity ratios are by weight unless otherwise noted specifically.

Figure 1:
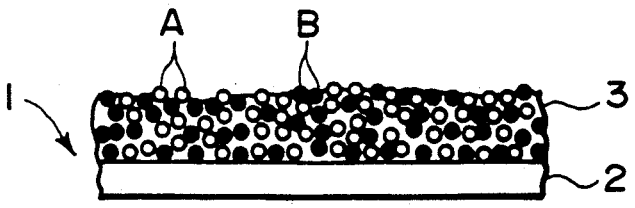
FIGS. 1 through 4 are schematic views each showing a section across the thickness of an example of the thermal transfer material according to the present invention.
Figure 2:
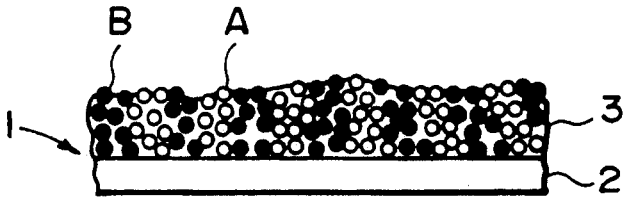

FIGS. 1 and 2 are respectively a schematic sectional view of an example of the thermal transfer material according to the present invention.

The term "domain" used herein refers to a region which can be discriminated from the other in a heterogeneous system in respect of composition, physical property, etc. Each domain is composed of a single or plural heat-fusible resin particles, or a non-particulate phase.

Referring to FIGS. 1 and 2, a thermal transfer material 1 comprises a support 2 ordinarily in the form of a sheet, and a heat-transferable ink layer 3 comprising a heat-fusible material and disposed on the support 2.

The heat-transferable ink layer 3 comprises, e.g., two species, i.e., species A denoted by white circles and species B denoted by black circles, of heat-fusible resin particles. More specifically, in the example of FIG. 1, a single heat-fusible resin particle of species A or species B forms a domain. In the example of FIG. 2, each domain is composed of an aggregate of plural heat-fusible resin particles of species A or species B. Further, it is also possible that domains of individual particles and domains of aggregated particles are present in mixture.

Incidentally, the term "heat-fusible" used herein refers to a property of becoming a liquid or softening on heat-application to develop a viscosity or an adhesion.

In the thermal transfer materials shown in FIGS. 1 and 2, the weight proportions between the different species of heat-fusible resin particles constituting the heat-transferable ink layer may be arbitrarily selected depending on the functions and physical properties possessed by the respective species and need not be particularly limited. However, in order to sufficiently exhibit the effect of the combination, domains of two or more species may preferably have a composition comprising 100 parts of one species and 2–100 parts, particularly 5–100 parts, of the other species.

Figure 3:
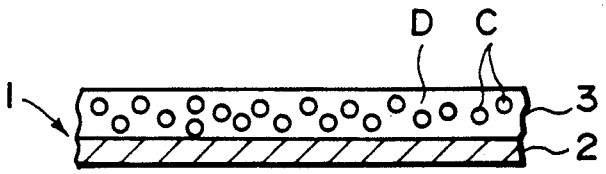
Figure 4:
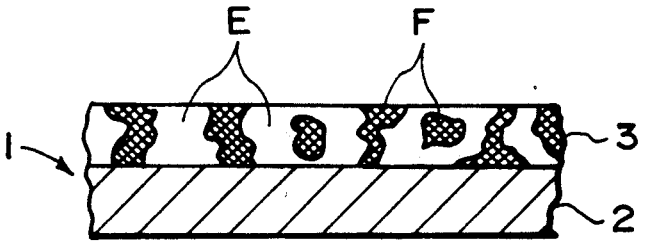

In the examples shown in FIGS. 1 and 2, the respective domains retain a particle characteristic, whereas as shown in examples of FIGS. 3 and 4, it is possible that at least one species of domain has lost its particle characteristic to form a non-particulate phase.

In the example of the thermal transfer material shown in FIG. 3, the heat-transferable ink layer 3 comprises heat-fusible resin particles C and a non-particulate phase D respectively forming at least one domain. A single heat-fusible resin particle C may constitute a domain, or alternatively an aggregate of particles C may constitute a domain. Further, it is possible to form domains of two or more species by using different kinds of heat-fusible resin particles C. In this case, by using different kinds of particles, there is formed a state wherein domains with different functions or physical properties such as adhesion and cohesion on heating are formed, so that the respective functions or physical properties may be readily developed. Similarly, the non-particulate phase D can constitute two or more species of domains, e.g., as those obtained through phase separation.

The weight proportions between the heat-fusible resin particles and the non-particulate phase constituting the heat-transferable ink layer may be arbitrarily determined, but it is preferred to use 2 to 400 parts, particularly 5–200 parts of the non-particulate phase with respect to 100 parts of the heat-fusible resin particles.

In the example of the thermal transfer material shown in FIG. 4, the heat-transferable ink layer 3 comprises two kinds of non-particulate phases of species E (shown in white in the figure) and species F (shown in black) respectively forming domains.

The proportions of the different species of non-particulate phases constituting the heat-transferable ink layer 3 may be arbitrarily selected depending on the functions and physical properties possessed by the respective phases and need not be particularly limited. However, in order to sufficiently exhibits the effect of the combination, domains of two or more species may preferably have a composition comprising 100 parts of one species and 2–100 parts, particularly 5–100 parts of the other species.

In the examples of the thermal transfer material according to the present invention explained with reference to FIGS. 1–4, the heat-transferable ink layer 3 contains a colorant as desired, and may also contain various additives such as a plasticizer and an oil, as desired.

As the support 2, it is possible to use films or papers known in the art as such. For example, films of plastics having relatively good heat resistance such as polyester, polycarbonate, triacetylcellulose, polyphenylene sulfide, polyimide, etc., cellophane, parchment paper or capacitor paper, can be preferably used. The support should have a thickness desirably of 1 to 15 microns when a thermal head is used as a heating source during heat transfer, but it is not particularly limited when using a heating source capable of heating selectively the heat-transferable ink layer, such as a laser beam. Also, in the case of using a thermal head, the surface of the support to contact the thermal head can be provided with a heat-resistant protective layer comprising a silicone resin, a fluorine-containing resin, a polyimide resin, an epoxy resin, a phenolic resin, a melamine resin, an acrylic resin or nitrocellulose to improve the heat resistance of the support. Alternatively, a support material which could not be used in the prior art can also be used by provision of such a protective layer.

The heat fusible material constituting the heat-fusible resin particles or non-particulate phase in the heat-transferable ink layer may be waxes such as carnauba wax, paraffin wax, sasol wax, microcrystalline wax, and castor wax; higher fatty acids and their derivatives inclusive of salts and esters such as stearic acid, palmitic acid, lauric acid, aluminum stearate, lead stearate, barium stearate, zinc stearate, zinc palmitate, methyl hydroxystearate, and glycerol monohydroxystearate; polyamide resin, polyester resin, very high molecular weight epoxy resin, polyurethane resin, acrylic resin (polymethyl methacrylate, polyacrylamide, etc.); vinyl-type resins such as vinyl acetate resin, polyvinyl pyrrolidone, and polyvinyl chloride resin (e.g., vinyl chloridevinylidene chloride copolymer, vinyl chloride-vinyl acetate copolymer, etc.); cellulose resins (e.g., methylcellulose, ethylcellulose, carboxycellulose, etc.), polyvinyl alcohol resin (polyvinyl alcohol, partially saponified polyvinyl acetate, etc.), petroleum resins, terpene resins, rosin derivatives, coumarone-indene resin, novalak-type phenol resin, polystyrene resins, polyolefin resins (polyethylene, polypropylene, polybutene, ethylene-vinyl acetate copolymer, etc.), polyvinyl ether resin, polyethylene glycol resin, elastomers, natural rubbers, styrene-butadiene rubber, and isoprene rubber.

The softening temperature of the heat-fusible material may be 40°-150° C., preferably 60°-140° C. The melt viscosity may preferably be $2\times10^4$-$20\times10^4$ centipoises as measured by a rotary viscometer at 150° C.

Examples of the heat-fusible resin constituting the heat-fusible resin particles include waxes, polyolefin resins such as low-molecular weight polyethylene, polyamide resins, polyester resins, epoxy resins, polyurethane resins, acrylic resins, polyvinyl chloride resins, polyvinyl acetate resins, petroleum resins, phenolic resins, polystyrene resins, and elastomers such as styrene-butadiene rubber and isoprene rubber.

The heat-fusible resin particles may be resin particles having a softening temperature of 50°-160° C., preferably 60°-150° C., selected from those prepared through various processes including polymerization processes such as emulsion polymerization and suspension polymerization, a process for mechanically dispersing a heat-fusible resin in the presence of a dispersant, mechanical pulverization, spray drying, precipitation, etc. Herein, the softening temperature refers to a flow initiation temperature as measured by means of Shimazu Flow Tester, model CFT-500 under the conditions of a load of 10 kg and a temperature raising rate of 2° C./min.

The two or more species of domains contained in the heat-transferable ink layer, either particulate or non-particulate, may preferably have a difference in softening temperature of 5° C. or more, particularly 10° C. or more, between the highest and the lowest softening temperatures.

The heat-fusible resin particles should preferably have an average particle size of 20 microns or less (down to the order of 0.01 micron), particularly 10 microns or less (down to the order of 0.1 micron). Above 20 microns, the particle size can reach the ink layer thickness. In this case, some voids are liable to remain in the heated ink pattern when heated to cause fusion on heat application to result in poor transferability. For this reason, it is not desirable that the particle size and the ink layer thickness are of the same order.

It is preferred that the heat-transferable ink layer has a thickness of 1-20 microns, particularly 2-10 microns. If the heat-transferable ink layer thickness is below 1 micron, the film strength of the heated ink pattern becomes too small, whereas the thickness above 20 microns causes difficulty in forming a uniform film.

The colorant may be one or two or more species selected from all of the known dyes and pigments including: carbon black, Nigrosine dyes, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Kayaset YG, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. These colorants may preferably be used in a proportion of 3 to 300 parts per 100 parts of the heat-fusible material.

In the thermal transfer material according to the present invention, the heat-transferable ink layer may for example be formed by applying a coating liquid containing heat-fusible resin particles as described above or a dispersion thereof, or a heat-fusible material or its solution or dispersion, and optionally used colorant and additives according to an ordinary method, followed by heating as desired. Incidentally, in order to leave heat-fusible resin particles in the heat-transferable ink layer in their particulate form, the applied coating liquid may be dried by heating at a temperature below the softening point of the heat-fusible resin particles.

For example, the heat-transferable ink layers 3 in FIGS. 1 and 2 may be formed by appropriately selecting two or more species of particles from the above enumerated heat-fusible resin particles, mixing the particles and dispersing the particles on the support, followed by heating the particles to a temperature below the softening point so as to cause the particles stick to the support. However, it is particularly preferred to form such heat-transferable ink layers by mixing dispersion liquids of two or more species of heat-fusible resin particles, e.g., in the form of resin emulsions, applying the mixture to form a coating, and drying the coating at a temperature lower than the lowermost temperature of the two or more species of the resin particles. In this case, an optional colorant, additive, etc., may be contained in the dispersion of the particles.

The heat-transferable ink layer 3 shown in FIG. 3 is particularly preferably formed by mixing dispersion liquids of two or more species of heat-fusible resin particles selected from those enumerated above,, e.g., in the form of resin emulsions, applying the mixture to form a coating, and drying the coating at a temperature higher than the uppermost temperature of the two or more species of the resin particles. In this case, an optional colorant, additive, etc., may also be contained in the dispersion or the particles. According to this method, the particles having a softening temperature below the drying temperature form a non-particulate phase and the particles having a softening temperature above the drying temperature remain in the form of particles.

Further, the heat-transferable ink layer 3 shown in FIG. 4 may for example be formed by dispersing in a solution of a heat-fusible binder a pulverized product of a heat-fusible material insoluble in the solvent of the solution, and applying the dispersion to form a coating layer, followed by drying and fusion through heating; or by forming a coating formulation of a combination of mutually incompatible heat-fusible binders such a ethylene/vinyl acetate copolymer resin and vinyl acetate resin or cellulose resin and acrylic resin through hot-melt mixing or solution mixing, applying the formulation and causing phase separation, if necessary, on heating.

As a method different from those described above, it is particularly preferred to form such a layer by mixing dispersion liquids of two or more species of heat-fusible resin particles, e.g., in the form of resin emulsions, applying the mixture to form a coating, and drying the coating at a temperature higher than the uppermost temperature of the two or more species of the resin particles. In this case, optional colorant, additive, etc., may be contained in the dispersion or the particles.

In view of the relationship of the film strength formed after heating and the adhesion on heating, the combination of the two or more species of particles or binders constituting the heat-transferable ink layer 3 shown in FIG. 4 may preferably be a combination selected from those listed below. Thus, wax or polyolefin resin such as low-molecular weight polyethylene-polyurethane resin, polyolefin resin-polyvinyl acetate resin, ethylene/vinyl acetate resin-styrene/butadiene resin, and a ternary system such as acrylic resin-polyvinyl acetate resin-petroleum resin.

In order to obtain recorded images of good quality, it is preferred to provide a large difference in cohesion between the heated portion and the non-heated portion of the ink layer. For this purpose, it is preferred that at least one species of domains among two or more species of domains contains oxidized polyethylene having a number-average molecular weight of 1300 or higher, particularly 2000–10000.

If the oxidized polyethylene has a number-average molecular weight of below 1300, the film strength of the resultant transferred image after heating is lowered.

The oxidized polyethylene may be contained in any species of the domains constituting a heat-transferable ink layer, and can be contained in two or more species of the domains. The oxidized polyethylene may preferably be contained in an amount of 30% or more of the total amount of the heat-fusible material contained in the heat-transferable ink layer so that the effect thereof is sufficiently exhibited.

The oxidized polyethylene may be obtained by oxidizing a linear or branched low-molecular weight polyethylene obtained through, e.g., a high temperature-high pressure polymerization process, a low pressure polymerization process using a Ziegler catalyst, or thermal decomposition of polyethylene for general molding purpose. The oxidized polyethylene may have a structure including a repeating unit of $-CH_2-CH_2)$ and also a functional group such as a carboxyl group or hydroxyl group introduced thereinto. The oxidized polyethylene may practically have an acid value of the order of 10–40 mgKOH/g measured according to ASTM D1386. Examples of the commercially available products include Hoechst Wax PED-121, PED-153, PED-521, PED-522 (mfd. by Hoechst A.G.); A-C Polyethylene 629, 680, 330, 392, 316 (mfd. by Allied Chemical Corp); and Mistui Hi-Wax 4202 E. The oxidized polyethylene particles may be used in the form of an aqueous dispersion which has been prepared by dispersing the oxidized polyethylene under an elevated pressure and an elevated temperature in the presence of an emulsifier such as a surfactant or an alkali.

Another heat-fusible material to be combined with the above mentioned oxidized polyethylene may preferably be selected so as to provide a high adehsion on heating onto a recording medium and a preferred relationship for transfer of a heated ink pattern onto a recording medium and formation of a recorded image.

For this purpose, in view of the relationship between the film strength of the heated ink pattern and the adhesion on heating, examples of the preferred combination include: oxidized polyethylene-ethylene/vinyl acetate copolymer resin, oxidized polyethylene-polyvinyl acetate resin, oxidized polyethylene-polyurethane resin, oxidized polyethylene-acrylic resin, oxidized polyethylene-styrene/butadiene resin, and a ternary system of oxidized polyethylene-polyvinyl acetate resin-petroleum resin.

The heat-transferable ink layer containing oxidized polyethylene may preferably have a thickness of 2–25 microns, particularly 3–20 microns.

The shape of the heat-sensitive transfer material of the present invention is not particularly limited as far as it is basically planar, but it is generally shaped in the form of a tape or ribbon as in a typewriter ribbon or a tape with wide width as used in line printers, etc. Also, for the purpose of color recording, the heat-sensitive transfer material of the inventions can be formed by applying several kinds of color tones of heat-fusible inks in stripes or blocks on a support.

Operation for the thermal transfer recording method employing the above explained thermal transfer material is not particularly different from that of the conventional method. However, by adopting the following method, a better quality of recorded images can be obtained.

Figure 5:
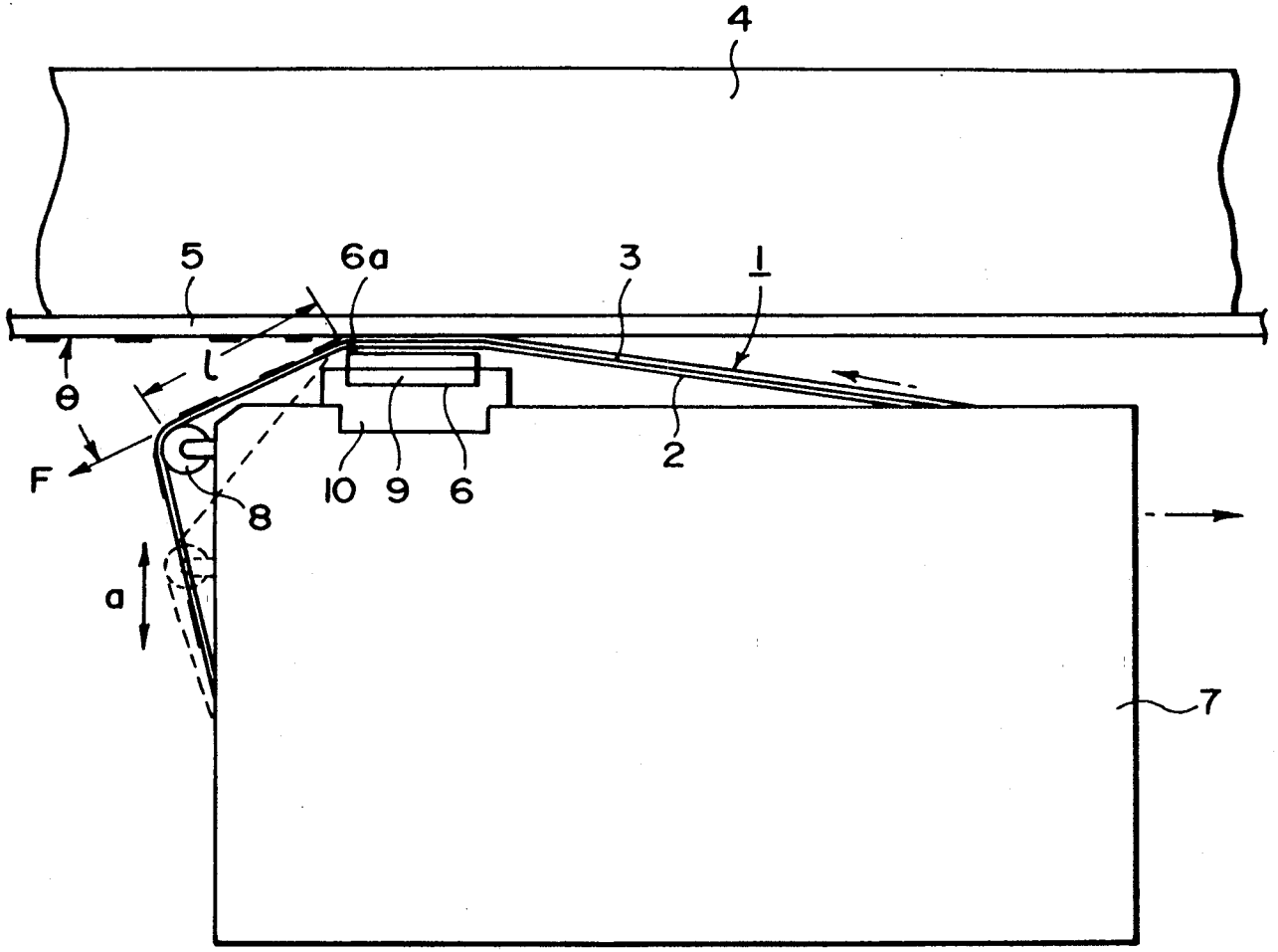
FIG. 5 is a schematic side view of an apparatus for practicing the thermal transfer recording method according to the present invention.

FIG. 5 is a schematic side view of an apparatus for practicing the thermal transfer recording method according to the present invention.

Referring to FIG. 5, the ink layer 3 of a thermal transfer material 1 as described above is caused to closely contact a recording medium 5 such as paper the back side of which is supported by a platen roller 4, and a recording head 6 having a heat generating element 6*a* is pressed against the support 2 of the thermal transfer material 1 so as to apply a heat pulse. On application of heat, the heated pattern of the heat-transferable ink layer 3 assumes a half-melted state to have an increased cohesion and attach to the recording medium 5. Then, the thermal transfer material 1 is peeled off the recording medium 5 at the end portion of the recording head 6.

The recording head 6 attached to a radiation plate 9 is mounted on a carriage (not shown) for moving in parallel with the platen roller 4 by the medium of a supporting base 10 so that the recording head is movable up and down (toward and away from the platen roller 4).

The thermal transfer material 1 is stored in a cassette 7 which is detachably mounted on the carriage and has a roller 8, so that it is unwound from and rewound in the cassette 7.

By the above arrangement, it is possible to form clear transferred images even on a recording medium having poor surface smoothness.

In the thermal transfer recording method using the above mentioned thermal transfer material, it is preferred to set a time from the heat application to the peeling off of the thermal transfer material (hereinafter referred to as "peeling time") to 50 milli-seconds or shorter. In setting the peeling time, it is preferred to set an angle $\theta$ formed between the thermal transfer material 1 and the recording medium 5 (hereinafter referred to as "peeling angle") to 10–50 degrees and to set a distance 1 for the thermal transfer material 1 retaining a constant peeling angle $\theta$ (hereinafter referred to as "peeling distance") to 50 mm or shorter.

The above mentioned peeling time may be adjusted by controlling the recording speed, and the peeling angle and the peeling distance may be adjusted by adjusting the position of the roller 8 attached to the cassette 7.

The reason why the above arrangement is effective for providing clear transferred images will now be explained.

The thermal transfer material 1 having an ink layer 3 composed of at least two species of domains of heat-fusible binders, provides a cohesion which is much smaller than that in a homogeneous system. When the ink having at least two domains is supplied with a heat in a pattern, uniformization proceeds in a pattern-heated portion to provide a heated ink pattern having a high cohesion and a viscous force acting as an adhesion of the ink pattern onto the recording medium 5. Further, when the heat-fusible binders are composed of at least two species of domains, there are domains having different functions or physical properties such as adhesion and cohesion on heating, so that respective functions or physical properties can be readily developed compared with a case of a uniform system. As a result, in the heat-transferable ink layer 3, there occurs a large difference in cohesion between a pattern-heated portion and non-heated portion, whereby a clear recorded image with sharp edges may be obtained after the transfer operation. This effect is enhanced if at least one species of domain in the heat-transferable ink layer contains oxidized polyethylene as described above.

The ink layer 3 of the thermal transfer material 1 constituted as described above is solid before heat application so that it tenaciously adheres to the support 2, but on heat application, assumes a half-melted state to have a weaker adhesion so that it becomes readily peelable from the support. With the elapse of time thereafter, the ink re-solidifies to resume a strong adhesion onto the support.

Figure 6:
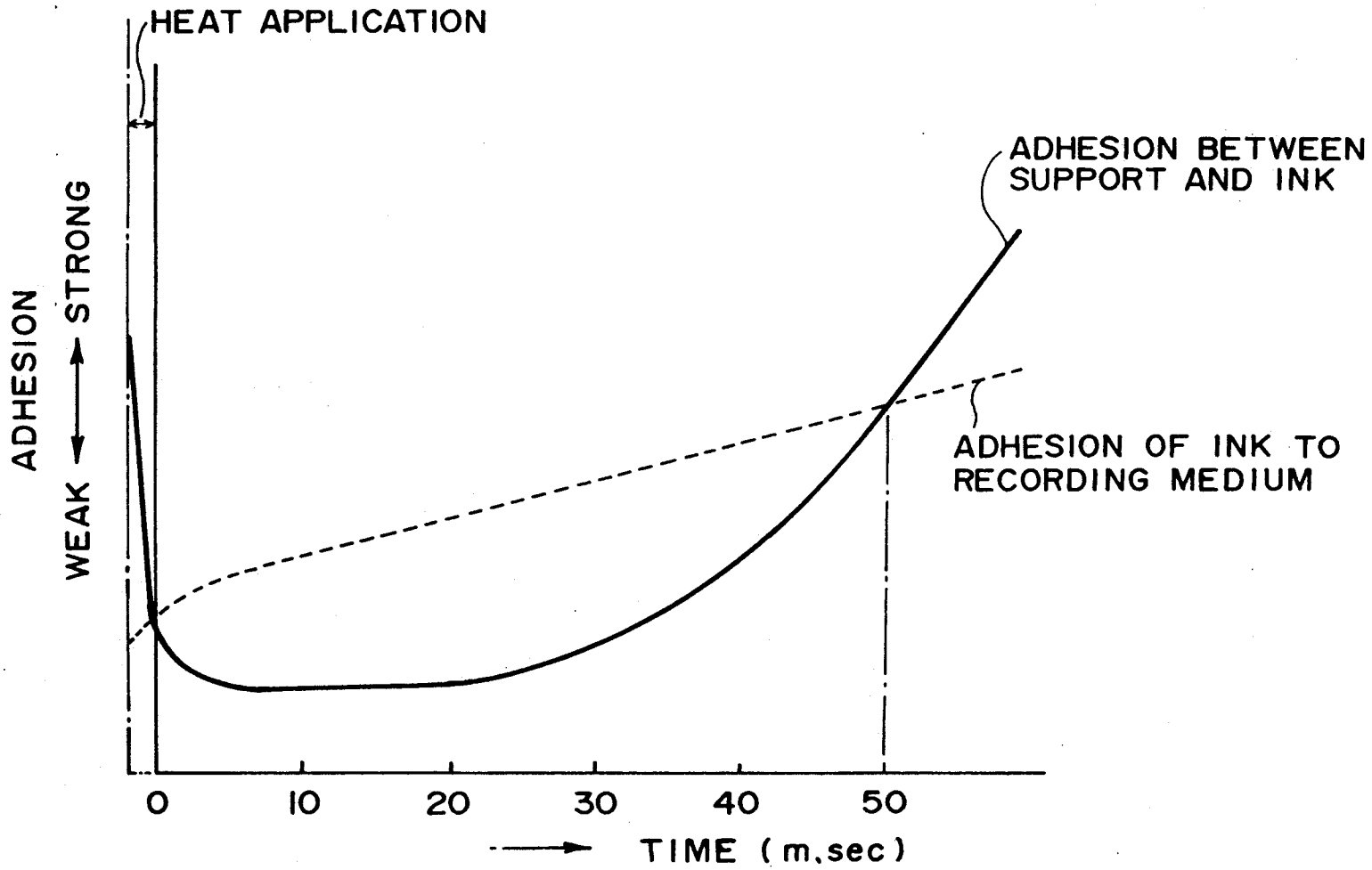
FIG. 6 is a graph showing differences of adhesives of a heat-transferable ink layer to a support thereof and a recording medium with the elapse of time from the heat application.

The behavior of the ink having the above described characteristic when used for transfer recording onto a recording medium having poor surface smoothness is now explained with reference to FIG. 6. During a period of from immediately before heat application to after the completion of the heat application, the ink 3 is gradually melted so that the adhesion thereof to the support is larger than that to the recording medium 5. During a period thereafter until about 50 milli-seconds, the ink 3 assumes a half-melted state so that the adhesion to the support 2 becomes weaker than the adhesion onto the recording medium 5. After about 50 milli-seconds from the heat application, the adhesion to the support again becomes greater than that to the recording medium.

This tendency is enhanced where the recording medium has poor surface smoothness.

As will be understood from the above explanation, when the ink 3 having the characteristics as described above is used for thermal transfer recording onto a recording medium 5 having poor surface smoothness, it is preferred to peel the thermal transfer material 1 off the recording medium 5 in a short time to provide a good transfer characteristic. On the contrary, if the thermal transfer material is peeled off after the elapse of some time, sufficient film transfer is not effected at surface concavities of the recording medium 5 to result in partial lacking of transferred images. This tendency is pronounced for a recording medium having a poor surface smoothness because there are fewer contact portions than on a recording medium having a high surface smoothness and the transfer characteristics are largely affected by a peeling time.

For this reason, in order to obtain transfer recorded images free of partial lacking, it is preferred to set the peeling time (i.e., a time from after the heat application to the peeling) to 50 msec or less, preferably 30 msec or less, most preferably 2–10 msec.

As for the peeling angle $\theta$, if the angle $\theta$ is smaller than 10 degrees, the spacing between the support 2 and the recording medium 5 becomes small and the adhesion between the ink layer 3 and the support is liable to operate, so that the point of separation between the thermal transfer material 1 and the recording medium 5 is shifted from the end portion of the recording head 6 to the downstream side in the running direction of the thermal transfer material 1. As a result, the adhesion of the ink 3 to the support 2 is liable to be larger than the adhesion to the recording medium 5, thereby to fail to provide a sufficient recorded image but to result in lacking of images. On the other hand, if the peeling angle $\theta$ exceeds 50 degrees, the ink 3 having an increased cohesion due to heat application is abruptly peeled off the support 2 so that even a non-heated portion of the ink is pulled because of the large cohesion to be peeled off, together thereby to result in excessive transfer and dull edges of images.

For these reasons, the peeling angle should preferably be set to the range of 10–50 degrees, particularly 20–30 degrees.

As for the peeling length l, the elongation $\Delta l$ during the section l under the condition that a constant tension F is exerted on the thermal transfer material 1, increases as the length l increases because the Young's modulus of the thermal transfer material is almost constant. As a result, the thermal transfer material 1 is liable to slacken to shift the point of separation between the thermal transfer material 1 and the recording medium 5 to the downstream side. Thus, the peeling time becomes longer as in the above mentioned case of the peeling angle being smaller than 10 degrees to result in lacking of images. Incidentally, it is not suitable to decrease the tension F in order to minimize $\Delta l$, because the decrease in tension results in instability in conveyance of the thermal transfer material 1.

For these reasons, the peeling distance should desirably be set to 50 mm or shorter, preferably 30 mm or shorter, further preferably 1–10 mm.

As described above, thermal transfer recording may be effected with good transfer characteristics even on recording medium having poor surface smoothness by using a specific ink layer 3 as described above and setting the peeling time to a specific range of 2–50 milli-sections, preferably by setting the peeling angle and the peeling distance to the above described specific ranges.

On the other hand, in the conventional transfer recording method wherein a heat-fusible ink is melted on heating and caused to penetrate into a recording medium, and thereafter the thermal transfer material and the recording medium are peeled off each other, the transfer characteristics are not remarkably affected by changes in peeling time, peeling angle, and peeling distance.

Except for using the specific peeling time, and preferably the peeling angle and peeling distance in the specific ranges, the other operation of the thermal transfer recording method according to the present invention, including, e.g., the tension F, are not different from those used in the conventional method. More specifically, the recording system may be of any type including serial type as used in typewriters and a line type as used in facsimiles.

Further, the recording head 6 may also be of a serial type or a line type, and the entire shape thereof need not be particularly restricted. However, the heat generating portion 6a of the recording head 6 may preferably be disposed as close as possible to the end of the head 6, in order to clearly define the point of separation between the thermal transfer material 1 and the recording medium 5 and also to shorten the time between the heat application and the separation (peeling).

Further, the peeling angle $\theta$ and peeling distance l may be easily defined by various means inclusive of a guide post disposed on a carriage of a serial printer, an edge-like peeling member disposed in parallel with and apart by a distance l from a line head of a line printer, etc.

Hereinbelow, the present invention will be explained more specifically while referring to specific examples of practice. Incidentally, the number-average molecular weight of a resin inclusive of oxidized polyethylene was measured in the following manner.

Molecular Weight Measurement

The VPO method (Vapor Pressure Osmometry Method) is used. A sample polymer is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0=RT/Mn$, the number average molecular weight Mn of the sample is derived.

EXAMPLE 1

| <Ink 1> | |
|---|---|
| Wax emulsion (Softening temp.: 80° C., average particle size: 1 micron) | 70 parts |
| Acryl-styrene copolymer emulsion (Softening temp.: 95° C., average particle size: about 0.2 micron) | 30 parts |
| Fluorine-containing surfactant | 1 part |
| Carbon black aqueous dispersion | 18 parts |

(The amounts of aqueous emulsions, dispersions or solutions for providing an ink formulation in this example and the other examples are all expressed based on their solid contents.)

The above components were sufficiently mixed under stirring to prepare an ink 1 of a solid content of 25%.

A 3.5 micron-thick polyester support provided with a heat-resistant protective layer formed by applying an addition-type silicone resin for release paper at a rate of 0.3 g/m$^2$ followed by drying was provided, and the ink 1 was applied by means of an applicator onto a side of the polyester support opposite to that provided with the heat-resistant protective layer, followed by evaporation of water at 60° C., to form a 3 micron-thick ink layer. Thus, a thermal transfer material (A) as shown in FIG. 1 was obtained.

EXAMPLE 2

| <Ink 2> | |
|---|---|
| 25% Low-molecular weight oxidized polyethylene aqueous dispersion (Softening temp.: 130° C., particle size: about 2 microns) | 50 parts |
| 20% Wax emulsion (Softening temp.: 70° C., particle size: about 1 micron) | 50 parts |
| Carbon black aqueous dispersion | 18 parts |

The above components were mixed to prepare an ink 2, which was then applied on a 3.5 micron-thick PET (polyethylene terephthalate) film by means of an applicator, followed by drying at 80° C. to form a 3 micron-thick ink layer, whereby a thermal transfer material (B) as shown in FIG. 3 was obtained.

In the ink layer, particles of the low-molecular weight oxidized polyethylene were confirmed through microscopic observation.

EXAMPLE 3

| <Ink 3> | |
|---|---|
| 20% Wax emulsion (Softening temp.: 80° C., particle size: about 2 microns) | 70 parts |
| 15% Aqueous solution of water-soluble acrylic resin (Softening temp.: 60° C.) | 30 parts |
| Carbon black aqueous dispersion | 18 parts |

The above components were mixed to prepare an ink 3. The ink 3 was applied on the same PET film as used in Example 2, follows by drying at 70° C. to prepare a 3 micron-thick ink layer, whereby a thermal transfer material (C) as shown in FIG. 3 was obtained.

In the ink layer, particles of the wax were confirmed through microscopic observation.

EXAMPLE 4

| <Ink 4> | |
|---|---|
| Low-molecular weight oxidized polyethylene emulsion (Softening temp.: 95° C., particle size: about 0.7 micron) | 70 parts |
| Polyvinyl acetate emulsion (Softening temp.: 100° C., particle size: about 0.5 micron) | 30 parts |
| Fluorine-containing surfactant | 1 part |
| Carbon black aqueous dispersion | 18 parts |

The above components were mixed to prepare an ink 4, which was then applied on a 3.5 micron-thick PET film by means of an applicator, followed by drying at 105° C. to form a 3 micron-thick ink layer, whereby a thermal transfer material (D) was obtained.

In the heat-transferable ink layer, two species of non-particulate phases were confirmed through microscopic observation.

EXAMPLE 5

| <Ink 5> | |
|---|---|
| 20% Wax emulsion (Softening temp.: 70° C.) | 5 parts |
| Pulverized polyamide resin (Softening temp.: 90° C., particle size: 2 microns) | 50 parts |
| Sodium dodecylbenzenesulfonate | 2 parts |
| Water | 198 parts |
| Carbon black | 18 parts |

An ink 5 of the above composition was prepared by dissolving the sodium dodecylbenzene-sulfonate in the water, adding thereto the pulverized polyamide resin under stirring by means of a propeller-type stirrer, and adding and mixing therewith the wax emulsion and the carbon black dispersion.

The ink 5 was applied on the PET film as used in Example 4 by means of an applicator, followed by drying at 90° C. to form a 3 micron-thick ink layer. Thus, a thermal transfer material (E) as shown in FIG. 4 was obtained.

COMPARATIVE EXAMPLE 1

| <Ink 6> | |
|---|---|
| Polyamide resin (Softening temp.: 90° C.) | 100 parts |
| Isopropyl alcohol | 400 parts |

A thermal transfer material (F) was prepared by applying an ink 6 of the above composition on the PET film as used in Example 2 to form a 3 micron-thick ink layer.

The thus obtained thermal transfer materials (A)–(F) were subjected to thermal transfer recording under the following conditions:

Thermal head: Thin film head, 24 dot arrangement

1 Dot size: 0.14×0.15 mm

Dot spacing: 0.015 mm

Resistance of heat generating element: 315Ω

Application voltage: 13.2 V

Application pulse duration: 1.1 m.sec

Recording paper: bond paper (Bekk smoothness=-7–8 sec.)

Printing and transfer characteristics were evaluated by observation with naked eyes. The results are summarized in the following Table 1.

TABLE 1

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 1 | A | ○ | ○ | ○ |
| EXAMPLE 2 | B | ○ | ○ | ○ |
| EXAMPLE 3 | C | ○ | ○ | ○ |
| EXAMPLE 4 | D | ○ | ○ | ○ |
| EXAMPLE 5 | E | ○ | ○ | ○ |
| COMPARATIVE EXAMPLE 1 | F | X | Δ | Δ |

In the above table and the tables appearing hereinafter, the symbols respectively have the following meaning:

: Excellent for practical use,

Δ: Applicable to practical use but poor in performance, and

χ: Not appropriate to practical use.

EXAMPLE 6

| <Ink 7> | |
|---|---|
| Oxidized polyethylene aqueous dispersion (Number-average molecular weight 5000, Softening temp.: 140° C., particle size: 1 micron) | 55 parts |
| Polyvinyl acetate aqueous dispersion (Softening temp.: 105° C., particle size: 0.7 micron) | 45 parts |
| Carbon black aqueous dispersion | 20 parts |

The above components were mixed to prepare an ink 7. The ink 7 was applied on a 3.5 micron-thick PET film by means of an applicator, followed by drying at 80° C. to from a 4 micron-thick ink layer. Thus, a thermal transfer material (G) of a structure shown in FIG. 1 was obtained.

EXAMPLE 7

| <Ink 8> | |
|---|---|
| Oxidized polyethylene aqueous dispersion (Number-average molecular weight 3500, Softening temp.: 120° C., particle size: 1.5 micron) | 35 parts |
| Wax emulsion (Softening temp.: 75° C., particle size: 2 microns) | 45 parts |
| Ethylene-vinyl acetate copolymer aqueous dispersion (Softening temp.: 100° C., particle size: 0.8 micron) | 20 parts |
| Carbon black aqueous dispersion | 15 parts |

The above components were mixed to prepare an ink 8. The ink 8 was then applied onto a 3.5 micron-thick PET film in the same manner as in Example 6, followed by drying at 90° C., to form a 5 micron-thick ink layer, whereby a thermal transfer material (H) as shown in FIG. 3 was obtained.

EXAMPLE 8

| <Ink 9> | |
|---|---|
| Oxidized polyethylene aqueous dispersion (Number-average molecular weight 2000, Softening temp.: 110° C., particle size: 1 micron) | 70 parts |
| Acrylic resin aqueous dispersion (Softening temp.: 110° C., particle size: 0.8 micron) | 30 parts |
| Carbon black aqueous dispersion | 12 parts |

The above components were sufficiently mixed under stirring to prepare and ink 9. The ink 9 was applied on a 3.5 micron-thick PET film in the same manner as in Example 6, followed by drying at 110° C. to form a 4 micron-thick ink layer. Thus, a thermal transfer material (I) of a structure shown in FIG. 4 was obtained.

COMPARATIVE EXAMPLE 2

| <Ink 10> | |
|---|---|
| Carbon black | 12 parts |
| Carnauba wax | 20 parts |
| Paraffin wax | 50 parts |
| Ethylene-vinyl acetate resin | 18 parts |

The above components were mixed in a sand mill for 30 minutes while being heated at 130° C. for dispersing the carbon black to prepare an ink 10. the ink 10 was then applied by hot-melt coating onto a 3.5 micron-thick PET film to from a 4 micron-thick ink layer, whereby a thermal transfer material (J) was obtained.

COMPARATIVE EXAMPLE 3

| <Ink 11> | |
|---|---|
| Oxidized polyethylene aqueous dispersion (Number-average molecular weight 1100, Softening temp.: 103° C., particle size: 1.5 microns) | 70 parts |
| Ethylene-vinyl acetate resin aqueous dispersion (Softening temp.: 110° C., particle size: 0.7 micron) | 30 parts |
| Carbon black aqueous dispersion | 15 parts |

The above components were sufficiently mixed to prepare an ink 11. The ink 11 was then applied on a 3.5 micron-thick PET film, followed by drying at 90° C. to form a 4 micron-thick ink layer. Thus, a thermal transfer material (K) was obtained.

The thus obtained thermal transfer materials (G)-(K) were subjected to thermal transfer recording under the following conditions:

Thermal head: Thin film head, 24 dot arrangement,
Application energy: 30 mJ/mm$^2$,
Recording paper: Bekk smoothness=5 sec.

Printing and transfer characteristics were evaluated by observation with naked eyes. The results are summarized in the following Table 2.

TABLE 2

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 6 | G | ○ | ○ | ○ |
| EXAMPLE 7 | H | ○ | ○ | ○ |
| EXAMPLE 8 | I | ○ | ○ | ○ |
| COMPARATIVE EXAMPLE 2 | J | X | Δ | Δ~X |
| COMPARATIVE EXAMPLE 3 | K | Δ | Δ | Δ |

As shown in the above Tables 1 and 2, the thermal transfer material according to the present invention provided transfer recorded images of high qualities including a high density good edge sharpness, and good transfer characteristic.

Next, Examples carried out by using an apparatus as shown in FIG. 5 are described hereinbelow.

EXAMPLE 9

| | |
|---|---|
| Oxidized polyethylene aqueous dispersion (Number-average molecular weight: 5000, particle size: 1 micron, softening temp.: 140° C.) | 55 parts |
| Polyvinyl acetate aqueous dispersion (Softening temp.: 105° C., particle size: 0.7 micron) | 45 parts |
| Carbon black aqueous dispersion | 20 parts |

The above components were mixed to prepare an ink, which was then applied on a 3.5 micron-thick PET film by means of an applicator, followed by drying at 80° C. to form a 4 micron-thick ink layer. Thus, a thermal transfer material (L) was obtained.

Thermal transfer recording was carried by using the thermal transfer material (L) and a serial-type printer operated under the following conditions:

| | |
|---|---|
| (Operating Conditions) | |
| Heat application time | 0.8 m.sec |
| Application energy | 30 mJ/mm$^2$ |
| Recording speed | 25 cps |
| Recording medium | bond paper (Bekk smoothness = 5 sec.) |
| (Conditions for peeling thermal transfer material) | |
| Peeling angle | 30 degrees |
| Peeling distance | 30 mm |
| Peeling time | 3 m.sec |

Figure 7A:
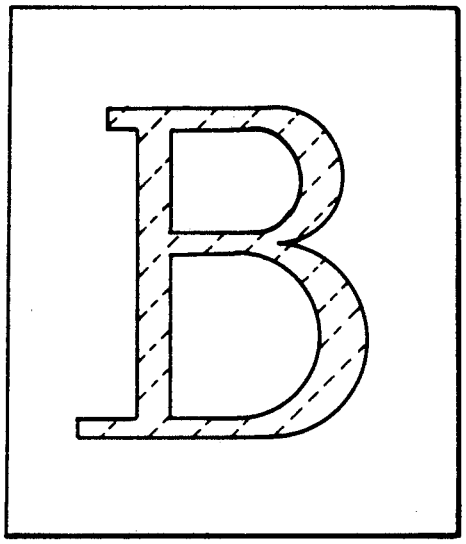
FIGS. 7A–7D show sketches of enlarged recorded images obtained under various thermal transfer recording conditions.

The recorded images obtained under the above conditions showed very clear edges with an example as shown in FIG. 7A.

EXAMPLE 10

Figure 7B:
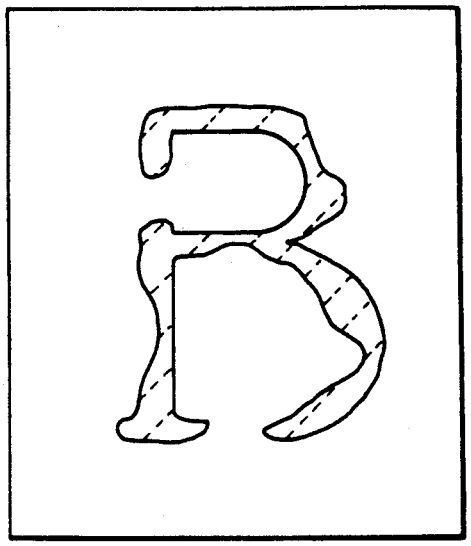

The procedure of Example 9 was repeated except that the peeling conditions were changed by disposing a projecting member for peeling delay downstream from the recording head 6 to set the peeling time to 70 m.sec. The resultant images gave noticeable lacking at edges of images with an example as shown in FIG. 7B.

EXAMPLE 11

The procedure of Example 9 was repeated except that the peeling angle was set to 5 degrees and the peeling distance was set to 30 mm to provide a peeling time longer than 50 m.sec. The resultant image were similar to the one shown in FIG. 7B and gave noticeable lacking of images.

EXAMPLE 12

The procedure of Example 9 was repeated except that the peeling angle was set to 30 degrees and the peeling distance was set to 70 mm to provide a peeling time longer than 50 m.sec. The resultant image was similar to one shown in FIG. 7B and gave noticeable lacking of images.

EXAMPLE 13

Figure 7C:
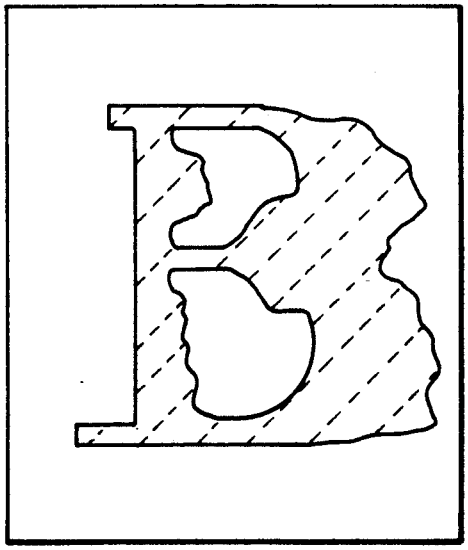

The procedure of Example 9 was repeated except that the peeling angle was set to 80 degrees and the peeling distance was set to 30 mm. The resultant image showed excessive transfer as shown in FIG. 7C.

EXAMPLE 14

Figure 7D:
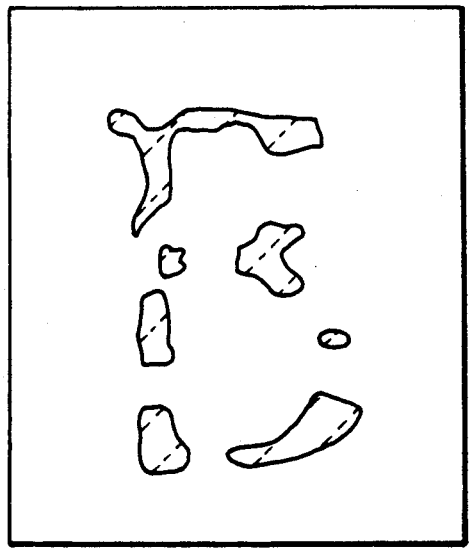

Thermal transfer recording was carried out on the recording medium used in Example 9 by using a conventional type of thermal transfer material having an ink layer of a heat-fusible ink containing wax as a predominant component, and a conventional printer. The resultant image showed much inferior image quality as shown in FIG. 7D and the image density was very low.

What is claimed is:

1. A thermal transfer material comprising:

a support, and a heat-transferable ink layer containing heat-fusible material disposed on the support, said heat transferable ink layer comprising at least two species of domains of different heat fusible-materials in the form of resin particles, and a colorant;

each of said resin particles comprising a resin selected from the group consisting of: polyamide resins, polyester resins, epoxy resins, polyurethane resins, acrylic resins, vinyl acetate resins, polyvinyl pyrrolidone, polyvinyl chloride resins, cellulose resins, polyvinyl alcohol resins, petroleum resins, terpene resins, rosin derivative resins, courmarine-indene resin, phenol resins, polystyrene resins, polyolefin resins, polyvinyl ether resins, polyethylene glycol resins, natural rubbers, styrene-butadiene rubber and isoprene rubber.

2. A thermal transfer material according to claim 1, wherein at least two species of domains comprise aggregated heat-fusible resin particles.

3. A thermal transfer material according to claim 1, wherein at least one species of said at least two species of domains comprises oxidized polyethylene having a number-average molecular weight of not lower than 1300.

4. A thermal transfer material according to claim 3, wherein said oxidized polyethylene has a number-average molecular weight of 2000–10000.

5. A thermal transfer material as in claim 1, wherein said colorant is disposed inside at least one of said at least two species of domains.

6. A thermal transfer material as in claim 1, wherein said colorant is disposed outside of said at least two species of domains.

7. A thermal transfer recording method comprising the steps of:

providing a thermal transfer material comprising a support and an ink layer of at least two species of domains of heat-fusible material in the form of particles, and a colorant disposed on the support;

superposing the thermal transfer material on a recording medium so that the ink layer contacts the recording medium;

supplying a heat pulse to the thermal transfer material from the support side; and peeling the thermal transfer material off the recording medium within 50 milli-sections after the heat application to cause a selective transfer of the ink layer to the recording medium.

8. A method according to claim 7, wherein said thermal transfer material is peeled off the recording medium within 30 milli-seconds after the heat application.

9. A method according to claim 7, wherein said thermal transfer material is peeled off the recording medium in a period of 2–10 milli-seconds after the heat application.

10. A method according to claim 7, wherein said thermal transfer material is peeled off the recording medium after the heat application so as to form an angle of 10–50 degrees from the recording medium.

11. A method according to claim 10, wherein said angle is in the range of 20–30 degrees.

12. A method according to claim 10, wherein said angle is retained at constant for a distance of 50 mm or less of the thermal transfer material.

13. A method according to claim 10, wherein said angle is retained at constant for a distance of 30 mm or less of the thermal transfer material.

14. A method according to claim 10, wherein said angle is retained at constant for a distance of 1–10 mm of the thermal transfer material.

15. A method according to claim 7, wherein at least one species of said at least two species of domains comprises oxidized polyethylene having a number-average molecular-weight of not lower than 1300.

16. A method according to claim 13, wherein said oxidized polyethylene has a number-average molecular weight of 2000–10000.

17. A thermal transfer recording method as in claim 7, wherein said colorant is disposed inside at least one of said at least two species of domains.

18. A thermal transfer recording method as in claim 7, wherein said colorant is disposed outside of said at least two species of domains.

* * * * *

UNITED STATES PATENT AND TRADEMARK OFFICE

CERTIFICATE OF CORRECTION

PATENT NO. : 5,133,820

DATED : July 28, 1992

INVENTOR(S) : MASATO KATAYAMA, ET AL.

It is certified that error appears in the above-indentified patent and that said Letters Patent is hereby corrected as shown below:

TITLE PAGE

Insert the following disclaimer notice:

**--[*] Notice: The portion of the term of this patent subsequent to November 8, 2005.**

IN [30] FOREIGN APPLICATION PRIORITY DATA

"60-491846" should read --60-191846--.

IN [56] REFERENCES CITED

Under FOREIGN PATENT DOCUMENTS, "82393 8/1985 Japan" should read --82393 5/1985 Japan--.

IN [57] ABSTRACT

Line 8, "milli-seconds" should read --milliseconds--.

COLUMN 1

Line 4, "continuation-in-part" should read --continuation--.
Line 23, "heat" should read --heat- --.
Line 65, "heat transferable" should read --heat-transferable--.

UNITED STATES PATENT AND TRADEMARK OFFICE

CERTIFICATE OF CORRECTION

PATENT NO. :5,133,820

DATED :July 28, 1992

INVENTOR(S) :MASATO KATAYAMA, ET AL.

It is certified that error appears in the above-identified patent and that said Letters Patent is hereby corrected as shown below:

COLUMN 2

Line 39, "milli-seconds" should read --milliseconds--.
Line 43, "above mentioned" should read --above-mentioned--.
Line 62, "adhesives" should read --adhesion--.

COLUMN 4

Line 44, "exhibits" should read --exhibit--.

COLUMN 5

Line 7, "heat fusible" should read --heat-fusible--.
Line 20, "chloridevinyli-" should read --chloride-vinyli- --.

COLUMN 6

Line 42, "above" should read --above- --.
Line 46, "stick" should read --to stick--.
Line 60, "above,," should read --above,--.

COLUMN 7

Line 10, "a" should read --as--.
Line 62, "$-CH_2-CH_2)$" should read -- $\leftarrow CH_2-CH_2 \rightarrow$ --.

COLUMN 8

Line 10, "above mentioned" should read --above-mentioned--.
Line 11, "adehsion" should read --adhesion--.
Line 34, "inventions" should read --invention--.
Line 38, "above explained" should read --above-explained--.

UNITED STATES PATENT AND TRADEMARK OFFICE

CERTIFICATE OF CORRECTION

PATENT NO. : 5,133,820

DATED : July 28, 1992

INVENTOR(S) : MASATO KATAYAMA, ET AL.

It is certified that error appears in the above-identified patent and that said Letters Patent is hereby corrected as shown below:

COLUMN 9

Line 5, "above mentioned" should read --above-mentioned--.
Line 8, "milli-seconds" should read --milliseconds--.
Line 16, "above mentioned" should read --above-mentioned--.
Line 55, "above described" should read --above-described--.
Line 63, "milli-seconds," should read --milliseconds,--.
Line 66, "milli-seconds" should read --milliseconds--.

COLUMN 10

Line 40, "pulled" should read --peeled--.
Line 55, "above mentioned" should read --above-mentioned--.

COLUMN 11

Line 2, "above described" should read --above-described--.
Line 51, "number average" should read --number-average--.

COLUMN 12

Line 50, "follows" should read --followed--.

COLUMN 13

EXAMPLE 5, "20% Wax emulsion 5 parts" should read --20% Wax emulsion 50 parts--.

COLUMN 14

Line 22, " : Excellent" should read -- O: Excellent--.
Line 25, "χ: Not" should read --X: Not--.

UNITED STATES PATENT AND TRADEMARK OFFICE

CERTIFICATE OF CORRECTION

PATENT NO. : 5,133,820

DATED : July 28, 1992

INVENTOR(S) : MASATO KATAYAMA, ET AL.

It is certified that error appears in the above-identified patent and that said Letters Patent is hereby corrected as shown below:

COLUMN 15

Line 29, "and" should read --an--.
Line 45, "the ink 10" should read --The ink 10--.

COLUMN 16

Line 27, "material" should read --materials--.
Line 50, "carried" should read --carried out--.

COLUMN 17

Line 14, "image" should read --images--.
Line 44, "heat transferable" should read --heat-transferable--.
Line 53, "courmarine-indene" should read --coumarone-indene--.
Line 59, "wherein at" should read --wherein said at--.

COLUMN 18

Line 24, "50 milli-sections" should read --50 milliseconds--.
Line 29, "milli-seconds" should read --milliseconds--.
Line 32, "milli-seconds" should read --milliseconds--.
Line 53, "molecular-weight" should read --molecular weight--.

UNITED STATES PATENT AND TRADEMARK OFFICE

CERTIFICATE OF CORRECTION

PATENT NO. : 5,133,820

DATED : July 28, 1992

INVENTOR(S) : MASATO KATAYAMA, ET AL.

It is certified that error appears in the above-identified patent and that said Letters Patent is hereby corrected as shown below:

COLUMN 18

Line 54, "claim 13," should read --claim 15,--.

Signed and Sealed this

Fifteenth Day of February, 1994

Bruce Lehman

BRUCE LEHMAN

*Commissioner of Patents and Trademarks*

*Attest:*

*Attesting Officer*